US008020346B2

(12) United States Patent
Singiser et al.

(10) Patent No.: US 8,020,346 B2
(45) Date of Patent: Sep. 20, 2011

(54) MAGNETICALLY SUPPORTED SLIDING TRACK SYSTEM

(76) Inventors: Joseph Singiser, Manahawkin, NJ (US); Eli A. Liedman, Brooklyn, NY (US)

( * ) Notice: Subject to any disclaimer, the term of this patent is extended or adjusted under 35 U.S.C. 154(b) by 183 days.

(21) Appl. No.: 11/893,475

(22) Filed: Aug. 16, 2007

(65) Prior Publication Data

US 2009/0044916 A1 Feb. 19, 2009

(51) Int. Cl.
*E05F 11/00* (2006.01)

(52) U.S. Cl. ..... 49/360

(58) Field of Classification Search ..... 49/404, 49/360

See application file for complete search history.

(56) References Cited

U.S. PATENT DOCUMENTS

| | | | | |
|---|---|---|---|---|
| 1,986,616 | A * | 1/1935 | Baldwin | 310/13 |
| 3,346,993 | A | 10/1967 | Johnson | 49/409 |
| 3,442,051 | A * | 5/1969 | Johnson et al. | 49/414 |
| 4,575,966 | A | 3/1986 | Gerritsen | 49/209 |
| 4,698,876 | A | 10/1987 | Karita | 16/102 |
| 4,991,887 | A | 2/1991 | Hahn | 292/251.5 |
| 5,712,516 | A | 1/1998 | Kabout | 310/12 |
| 5,806,346 | A * | 9/1998 | Schlinger et al. | 63/40 |
| 6,289,643 | B1 | 9/2001 | Bonar | 52/107 |
| 6,415,550 | B1 * | 7/2002 | Fin | 49/442 |
| 6,430,872 | B1 * | 8/2002 | Fin | 49/349 |
| 6,449,905 | B2 * | 9/2002 | Maki | 49/360 |
| 6,543,581 | B1 * | 4/2003 | Durand et al. | 187/316 |
| 6,942,001 | B1 | 9/2005 | Crider et al. | 160/241 |
| 7,013,605 | B2 * | 3/2006 | Zhou et al. | 52/30 |
| 7,504,788 | B2 * | 3/2009 | Haab et al. | 318/286 |
| 2001/0011439 | A1 * | 8/2001 | Maki | 49/360 |
| 2004/0128913 | A1 | 7/2004 | Spiess | 49/120 |
| 2005/0077989 | A1 * | 4/2005 | Edmonson, Jr. | 335/207 |
| 2008/0100152 | A1 * | 5/2008 | Busch | 310/14 |
| 2008/0209813 | A1 * | 9/2008 | Haab et al. | 49/360 |

FOREIGN PATENT DOCUMENTS

| | | | |
|---|---|---|---|
| DE | 4016948 | | 11/1991 |
| EP | 897449 | | 11/1997 |
| EP | 1659253 | | 5/2006 |
| JP | 03221687 | A * | 9/1991 |
| JP | 3244777 | | 10/1991 |
| JP | 4007483 | | 1/1992 |
| JP | 06101379 | A * | 4/1994 |
| JP | 6341267 | | 12/1994 |
| JP | 8338170 | | 12/1996 |
| JP | 2000/179223 | | 6/2000 |
| JP | 2002/021427 | | 1/2002 |
| JP | 2003/225720 | | 8/2003 |

* cited by examiner

*Primary Examiner* — Jerry Redman

(74) *Attorney, Agent, or Firm* — Ernest D. Buff; Ernest D. Buff & Associates LLC; Aniket Patel

(57) ABSTRACT

A sliding door or window supporting system has a stationary frame with a bottom track and a sliding portion that slides from a closed position to an open position. The bottom portion of the sliding portion and the upper surface of stationary frame track are provided with one or more magnets having identical magnetic polarity, thereby creating repulsion between the bottom of the sliding portion and the stationary track. Forces produced by magnetic repulsion lift the weight of the sliding portion, creating an air gap. A smooth, low friction sliding and door gliding movement results, which is immune to dirt and debris. The front to back movement of the sliding portion is supported by low friction polymeric knobs attached to a stationary frame and contacting sliding portion.

14 Claims, 2 Drawing Sheets

MAGNETICALLY SUPPORTED SLIDING TRACK SYSTEM

BACKGROUND OF THE INVENTION

1. Field of the Invention

The present invention relates to a magnetically supported sliding track suited for sliding doors and windows; and, more particularly to a sliding track for a door or window that provides minimal friction for sliding and may be optionally locked by electrical means from any sliding movement.

2. Description of the Prior Art

Many patents address issues related to a magnetically supported sliding window or door. The magnetic supports disclosed in the prior art hang the window or door in a magnetic support and use additional supporting means such as wheels or rods. In such cases, the easy-to-slide door or window is not supported by magnetic repulsion provided at the bottom track of the sliding door or window.

U.S. Pat. No. 4,698,876 to Karita discloses a door apparatus partially supported by a magnetic mechanism. Magnets mounted on the upper surface of the sliding door attract a stationary guide member. Even though the door is supported by four rollers, it is said that the magnetic force is sufficiently strong to limit the loading on the rollers. The sliding door is moved by a moving mechanism. It is the attraction of the magnet to the stationary guide that supports the sliding door weight, not repulsion. There are no magnets at the bottom of the supported sliding door.

U.S. Pat. No. 5,712,516 to Kabout discloses a stator-element for a linear-electrical-drive door provided with a stator-element as such. A stator element of a linear-electric-drive reciprocally slides over a limited length in a straight or curved line of a door, gate or carriage that is provided with a magnet or magetizable counter element. The stator is provided with an elongate holder, a number of rod-like, mutually parallel and adjacent carriers fixed transversely onto the holder. A number of windings each of which is wound around the carrier along a side of the holder and is connected onto a controlled voltage source so that accurate speed control of the body for moving can be obtained. The door is vertically hung by a plurality of magnets attracting a plate that is positioned on the upper portion of the door. The door is moved by an actuator that magnetically moves the sliding door. There are no magnets provided on the bottom of the sliding door that supports its weight.

U.S. Pat. No. 6,289,643 to Bonar discloses a residential motorized sliding door assembly. This motorized sliding door assembly includes a sliding door that slides longitudinally inside an outer support frame assembled in a standard 2×4 stud wall opening in a building. The support frame includes a load-bearing header located horizontally between two vertical posts and opposite a lower threshold. This door is hung vertically on tracks using wheels. A linear motor with coils and a magnet moves the sliding door. The door is not supported by magnetic repulsion. Rather, support for the door is provided by wheels that hang the sliding door from an upper track. No magnets on the bottom of the sliding door support its weight.

Foreign Patent Publication No. DE4016948 to Just et al. discloses a contactless magnetic guidance system for a sliding door. The system exploits mutual repulsion of like poles in radial permanent magnets at the edges of moldings and a guide. The system exploits mutual repulsion of like poles of radial permanent magnets at edges of moldings and a guide. The door is hung from a rod, which is connected to a body that floats inside a tubular passage that has plurality of opposing magnetic poles locating in the bottom portion of the passage, thereby suspending the sliding door and supporting it. The sliding door is displaced by a liner induction motor drive. The sliding door weight is not supported by magnets on the bottom of the sliding door and magnets on a stationary track. Since the magnets support only in the vertical direction, the sliding door is subject to front to back movement, which is not well constrained. Consequently, the body may rub against the tubular passage.

Foreign Patent Publication No. EP897449 to Schuster discloses an electromagnetic drive system for magnetic levitation and carrying systems. A permanent magnet connected to a suspended load is held between two soft electromagnet poles that are energized by a coil. The soft electromagnets are in a state of partial magnetic saturation, which means that the permanent magnet is attracted to both of the soft magnetic poles by magnetic attraction. An equal air gap is said to be maintained on both sides of the permanent magnet by mechanic means. The coils of the electromagnet are energized to change the start of magnetization of the soft magnet pole. The magnet supports the load and is on top, not in the bottom of the suspended load. Magnetic attractive forces support the suspended load; but the load is not supported by magnetic repulsion at the bottom of the load.

Foreign Patent Publication No. JP03244777 to Tsukamoto et al. discloses a magnetic levitation self-running type suspension sliding door. Two electromagnets placed on the upper surface of a sliding door support and drive the sliding door by first monitoring the gap between the electromagnet and the yoke coil directly below it and keeping it the same. The sliding door is uniformly supported thereby. Traveling motion of the door is provided by energizing the yoke coil. Traveling movement requires changes in the magnetic polarity of the yoke coil over which the sliding door rides. These changes sharply reduce the gap between the electromagnet and the yoke coil. No magnets are provided on the bottom of the sliding door, for supporting its weight.

Foreign Patent Application No. JP04007483 to Takahashi et al. discloses an opening and shutting device for magnetic levitation type sliding door. The sliding door is supported on a guide bearing lever, the one end of which rests on a rotatable shaft, while the other end is actuated up or down by magnets, sliding the inclined door one way or other by gravity. The door essentially slides on the guide bearing lever using rollers. No magnetic levitation of the door is indicated since the door hangs from rollers on a guide bearing lever and simply moves back and forth by gravity action as one end of the guide bearing lever is raised up or down by magnetic force. There are no magnets on the bottom of the sliding door supporting the weight of the sliding door.

Foreign Patent Publication No. JP06341267 to Okawa discloses a door opening/closing device. This door is magnetically supported by magnets suspending the door above a track with a gap 'G'. The magnets are electromagnets supporting the door and disposed in the upper portion of the sliding door. They provide support in the horizontal direction only. It is not clear how the door weight is supported in the vertical direction. The door is moved along the sliding direction by magnetic propulsion. This device can prevent entry of a person through the door. No magnets are operative at the bottom of the door to support the door's weight.

Foreign Patent Publication No. JP08338170 to Kihara discloses a sliding door device. This door has rollers on the top track for sliding of the sliding door. Magnets are placed on either side of the rollers to prevent the sliding door from slipping off of the roller track. The magnets are not disposed on the bottom surface of the sliding door and do not ride on a magnet having the same polarity disposed on a base track on the bottom of the stationary frame.

Foreign Patent Publication No. JP2000179223 to Kotani discloses an installation method for a double sliding door. The bottom portion of the sliding portion has a south magnetic pole while the upper portion of the stationary track has a north magnetic pole. There is thereby created an attractive force, not a repulsive force, which keeps the sliding door within the track. If one of the magnets is an electromagnet, shutting of the electromagnetic current makes it easy to remove the sliding door. This disclosure teaches away from suspending the weight of a door by repulsion between magnets provided at the bottom of the sliding door.

Foreign Patent Publication No. JP2002021427 to Makusamu discloses a sliding door. It appears from the drawing that a magnet provided at the top portion supports the sliding door. Two rollers are provided, presumably supporting the main weight of the sliding door. The magnets are not located on the bottom of the sliding door.

There remains a need in the art for a magnetically supported sliding door or window that is easy to slide back and forth and is immune to dirt accumulation at the sliding tracks provided under the sliding door or window. Moreover, there is a need for securely locking a sliding door or window without having to use latches and locks which are easily defeated by intruders.

SUMMARY OF THE INVENTION

The present invention provides a sliding door or window that is supported by repulsion of magnets that are placed on the bottom surface of a slider and the opposing portion of the stationary track. Since the repulsion essentially reduces or in a preferable mode entirely eliminates the gravitational downward load of the sliding door or window on the bottom track, the movement of the sliding door or window is accomplished with very little or no frictional resistance. The front to back movement of the magnetically supported sliding door or window is prevented by use of a plurality of low friction polymeric knobs in the stationary doorframe that contact the front and back surface of the sliding door or window.

Generally, the invention of the magnetically supported sliding track system broadly comprises: (i) a stationary frame having frame sides, an upper portion, and a lower portion; (ii) said lower portion of said frame having a channel with a lower track, wherein said lower track further includes one or more magnets, which may be permanent magnets or electromagnets such that the magnetic polarity of the magnets points upwards; (iii) a sliding portion having sides, a top, and a base; (iv) said base of said sliding portion including one or more magnets, which may be permanent magnets or electromagnets such that the bottom surface of the base of the sliding portion has an identical magnetic polarity pointing downwards; and (v) said base magnet of sliding portion and said stationary track magnets have same magnetic polarity so that said base magnet and stationary track magnet repel one another causing a force which forms a cushion between said base magnet and said stationary track magnet. Wherein the sliding portion glides upon the cushion formed by the force between the base and the lower track, enabling easy friction-free movement between the sliding portion along the track of the frame.

The repulsing between the magnet at the base and at the bottom of the sliding door tends to displace the sliding door in every possible direction due to the cushioning effect of the magnetic fields. However, the sliding door is constrained in its movement within said channel of the stationary frame lower portion, which has two polymeric knobs preventing front to back displacement of the sliding door or window. In addition, two similar polymeric knobs present on the upper channel of the stationary frame constrain the sliding door from front to back displacement. As a result, the sliding door or window can only move along the sliding direction. The door weight is entirely supported by the cushioning force between the repelling magnets and the sliding door or window essentially appears to 'float on air' over the stationary frame lower track magnet. Advantageously, the sliding movement of the door or window occurs with little or no friction, since substantially all of the sliding friction is extant only at the polymeric knobs, which contact the sliding door. The coefficient of friction between a polymer such as high molecular weight polyethylene or polytetrafluroethylene (PTFE) and a metal is generally very low, typically below 0.1. Moreover, the contact force between the polymeric knobs and the door is merely a small lateral force, since substantially the entire weight of the door is supported by the magnetic cushioning force. The frictional drag force is equal to the contact load times the coefficient of friction. The load in the vertical direction is small due to the support provided by the repulsive magnetic force and therefore, the frictional drag is very small. In the front to back direction, there is essentially no load and the low coefficient of friction of the polymeric knobs offer very little frictional drag. As a result, this configuration provides very smooth sliding movement of the sliding door or window.

Advantageously, the magnetically supported sliding track system significantly reduces the need for constant maintenance requirements and drastically extends the useful life of a sliding door or window installation. Magnets are utilized by the magnetically supported sliding track system to provide a sliding track system that guides sliding doors and windows along a cushion of force generated between the magnets.

In the first embodiments the magnet at the base of the sliding portion and the magnet at the lower track of the stationary frame are permanent magnets with the same magnetic polarity facing each other thereby repelling each other.

In a second embodiment, the base of the sliding door carries a permanent magnet with a selected magnetic polarity facing downwards, and the track of the stationary frame has an electromagnet that is energized by a wound DC coil. Essentially the same magnetic polarity is generated by the DC coil in the upward direction on the face of the stationary track member, causing the sliding door with the permanent magnet at the base to be repelled. This DC current must be passed constantly to maintain the electromagnet magnetic field. The sliding portion is supported by the cushion of magnetic force field, providing easy gliding movement of the sliding door or window. However, if the DC electrical current is switched off, the door is no longer supported by the cushion of the magnetic field force and the door drops down on the stationary frame track. Movement of the door becomes difficult due to the heavy weight of the door, which rests on the track, producing a high friction level. The magnetic attractive force between the permanent magnet at the bottom base of the slider locks against the soft magnetic core of the lower track, which is no longer energized by applied DC current. This provides a security measure. The door is locked solid once the DC energizing current is turned off; intruders are prevented from sliding the door open. Optionally a small latch or lock may be used to secure the sliding door.

In a third embodiment, both the lower track magnet and the sliding door bottom base magnets are electromagnets. The coils are wound so that the magnets produce the same magnetic polarity, causing repulsion at the base-sliding door interface. The DC current may be supplied by a battery, which is preferably a rechargeable battery or supplied by a rectified house current. Since both the magnets are electromagnets, they are not subject to demagnetization and are free from magnetic strength degradation. The electromagnet on the base of the sliding door may be energized while the electromagnet on the bottom of the sliding door may be switched off to lock the sliding door, preventing its movement and thereby preventing entry of intruders.

This repulsive magnetic field cushion is caused by close spacing of common magnetic poles of permanent magnets; or between a permanent magnet and an electromagnet; or between two electromagnets. This magnetic repulsion raises the door or window from the base, and therefore reduces the sliding friction, corrosion, stress loading, and the like, on the track system. Maintenance costs are reduced and the service life and reliability of the track system are increased, while damage owing to wear and tear is mitigated.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

Figure 1:
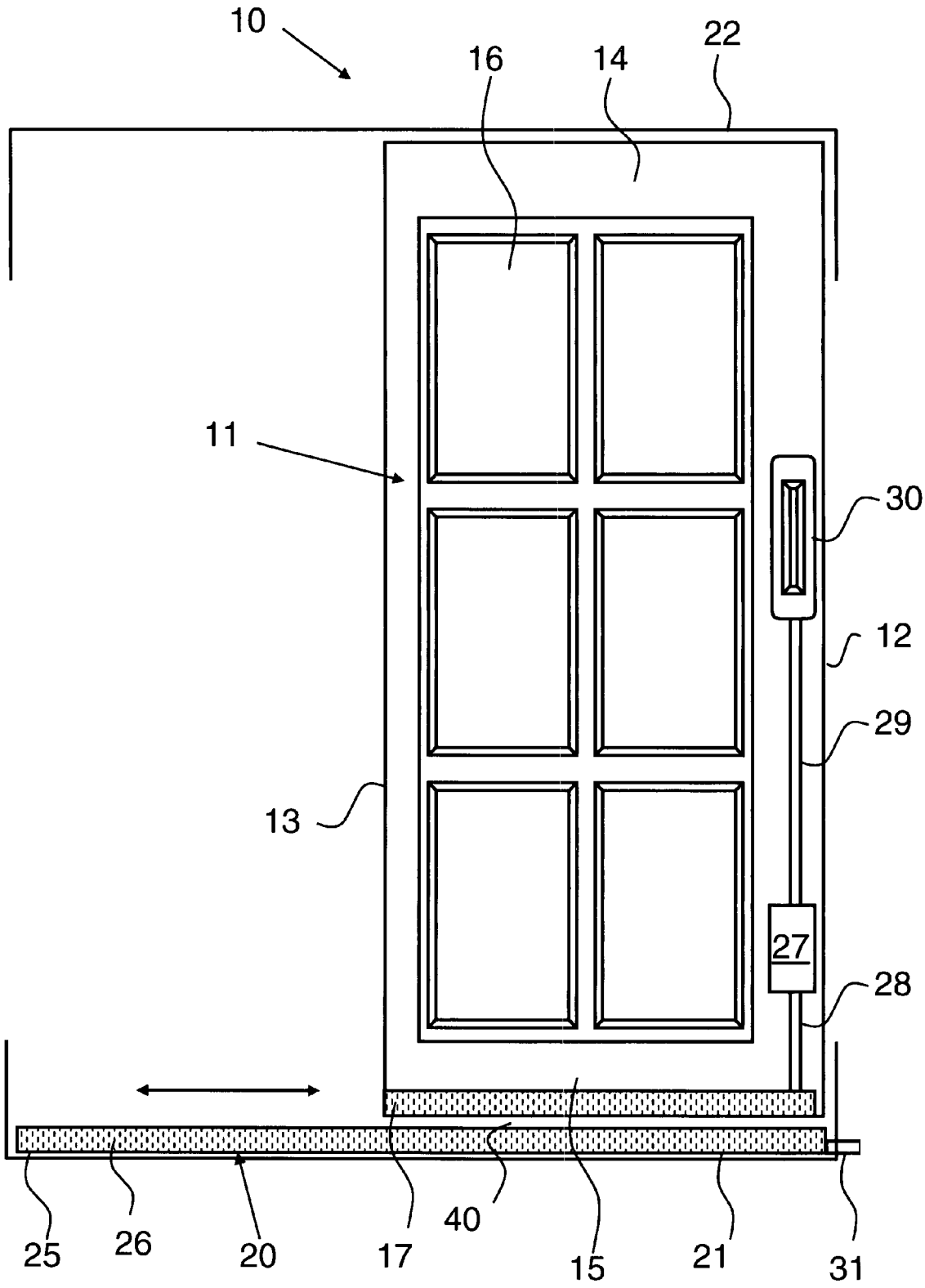
FIG. 1 is a front cross sectional view of an embodiment of the magnetically supported sliding track system.

Assemblies for sliding doors and windows are currently constructed using a track and rail arrangement. The rail mates with a groove located within the bottom of a frame and the bottom of a sliding door/window, respectively, and/or visa versa. These currently utilized sliding track rail-groove assemblies require continuous maintenance as they are highly susceptible to corrosion from weather and blockage from dirt and debris. Corrosion and blockage causes damage to the track assembly, causing the mating rail and groove to become disengaged thereby making it difficult, if not impossible, to slide the door or window to the desired position. As a result, these sliding track assemblies and/or doors and windows typically need repair and/or replacement on a semi-regular basis. Regular repair and replacements increase the time and expense required to maintain these doors and windows.

Generally the invention of the magnetically supported sliding track system broadly comprises: (i) a frame having frame sides, an upper portion, and a lower portion; (ii) the lower portion of the frame has a lower track configured to include one or more magnets such that the lower track has a common magnetic polarity pointing upwards; (iii) a sliding portion having sides, a top, and a base; (iv) said base of said sliding portion including one or more magnets such that the base surface has a common substantially identical magnetic polarity pointing upwards; and (v) said magnetic polarity of the base of sliding portion and that of the lower track magnet repel one another, causing a force which forms a cushion between said base magnets and said lower track magnets. With this arrangement, the sliding portion glides upon the cushion formed by the force between the base of the sliding portion and the lower track, enabling easy, friction-free movement between the sliding portion and the track of the frame.

The door frames and the base frames may be made from a ferromagnetic material, causing the magnets to automatically adhere to the frame. On the other hand, the frames may be made from a non-magnetic material, including aluminum. The magnet on the base and the magnet on the bottom of the slider should be bonded to the respective frames by an adhesive such as epoxy. Alternatively, the frames may be made from molded plastic, which is non-magnetic, and the magnets may be adhesively bonded to the plastic frame. Since the magnetic fields oppose each other, they may demagnetize each other. However, permanent magnets with a high energy product, typically in the range of 20 to 50 mega gauss oerstead (MGOe) are not subject to demagnetization. The preferred permanent magnet material is neodymium iron boron permanent magnet which an energy product approaching 50 MGOe.

The equations for the force between two magnetic poles are well known. The force generated is attractive for opposing magnetic poles, north pole and a south pole. The force generated is repulsive between like poles, for example north pole against north pole or south pole against south pole. The force generated is given by $$F=B^2A/(2\mu_o)$$

F is the force in newtons

B is the magnetic field in Tesla (1 T=$10^4$ Gauss.)

A is the area of the pole faces in square meters $\mu_o$ is the permeability of free space, which is $4\pi 10^{-7}$ $Hm^{-1}$ Thus, force generated per unit area is approximately 398 kPa or 57.7 pound force per square inch@B=1 Tesla. The force generated is significantly larger at B value of 2 Teslas, which is approximately 1592 kPa or 230.8 pound force per square inch. The B value of most magnetic materials range from 1 to 2 Teslas. When an electromagnet is used the B in Tesla is given by the equation $$B=\mu NI/L$$

N is the number of turns of wire around the electromagnet

I is the current in amperes

L is the length of the magnetic circuit.

Therefore the force is given by $$F=\mu N^2I^2A/(2L^2)$$

The weight of the sliding door or window is therefore supported by the repulsion between the magnets. The repulsive force decreases as a function of the separation between the magnetic poles. For small values of separation from 0 to 0.1 meter, this force is approximately $0.4\times\text{distance}^{-2.2}$.

FIG. 1 illustrates a front cross sectional view of an embodiment of the magnetically supported sliding track system, shown generally at 10. Magnetically supported sliding track system 10 includes a stationary frame 20 having frame sides, an upper portion 22, and a lower portion 21. Lower portion 21 of frame 20 is appointed with a lower track 25. Lower track 25 includes a lower track magnet 26 capable of receiving and maintaining a fixed magnetic polarity which may be a north magnetic pole or south magnetic pole depending on the design pointing upwards. A sliding portion 11, herein shown as a sliding door 11, includes outer side 12, inner side 13, top 14 and base 15. Sliding door 11 can include any number of styles or constructions, and herein is shown with a window area 16. Bottom base portion 15 of sliding door 11 includes a magnet 17 extending there along and being magnetized with the same magnetic polarity as that of magnet 26, but facing downwards. With this construction, the magnetic polarity of magnet 17 and magnetic polarity of magnet 26 repel each other, lifting the sliding door 11 upwards and preventing it from resting on the base lower track 25 creating an air gap 40.

The weight of the door or window is sustained by the repulsive magnetic field between the magnets. Sliding portion 11 glides upon this magnetic field cushion at 40 formed by the repellant forces between the base magnet 17 and lower track magnet 26 to move sliding portion 11 along track 25 of frame 20. The magnets may be permanent magnets or may be electromagnets. If the magnet 17 is an electromagnet, it may be powered by a DC current source such as a battery that is preferably rechargeable as shown at 27. Similarly, the magnet 26 may be an electromagnet powered by a similar battery or rectified house current 31. Switching off the DC current to one of the electromagnets causes loss of magnetic cushioning force and the sliding door or window frame to drop down on the track 25 creating high friction and locking the door or window. Further, the magnetic polarity of the opposing permanent magnet or energized electromagnet grabs the sliding door portion 11 against the de-energized electromagnetic strip, which is a soft ferromagnetic material, and firmly locks the sliding portion 11 against the track 25, providing a secure locking arrangement.

Figure 2:
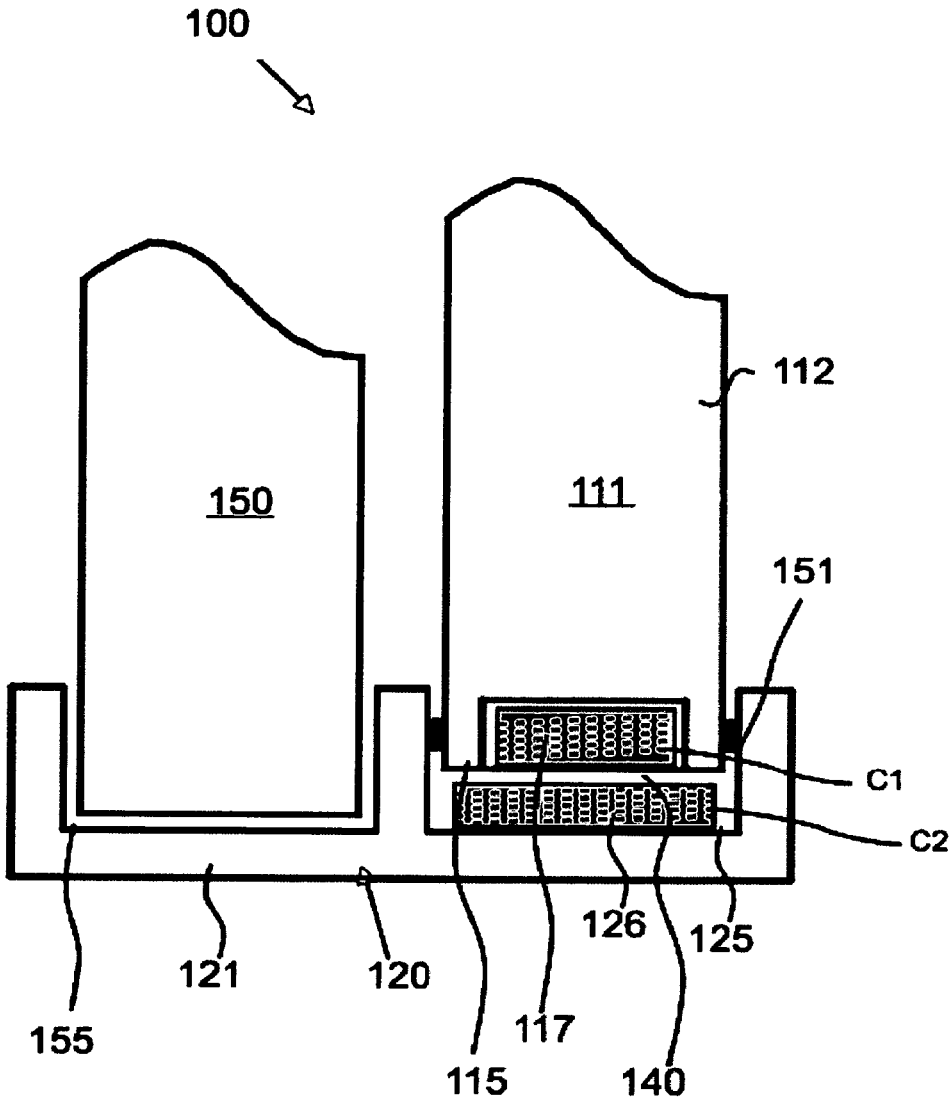
FIG. 2 is a side view of the magnetically supported sliding track system.

FIG. 2 shows generally at 100 a side view of the magnetically supported sliding track system. Frame 120 has frame sides and a lower portion 121. Lower portion 121 of frame 120 is appointed with a lower track 125 and second lower track 155 for receiving a fixed door 150 and a sliding door 111. Thus, frame 120 is herein constructed as a dual track system, with lower track 125 and supplemental track 155. Lower track 125 includes a lower track magnet 126 capable of receiving and maintaining a fixed selected magnetic polarity pointing upwards on the upper surface which may be north polarity or south polarity according to the design. A sliding portion 111 of a sliding door is retained in a lower track 125 as shown. A second door portion 150 of a generally fixed portion of the sliding door is retained in supplemental track 155 as shown. The bottom portion of the sliding door 111 has a recess 115 to retain a magnet. The bottom surface of this magnet has the same magnetic polarity as that of the upper surface of the magnet 126, but pointing downwards, thereby causing magnetic repulsion between magnet 117 and magnet 126 and supporting the weight of the sliding door 111 creating an air gap 140. The front to back movement of the sliding door 111 is prevented by a plurality of polymeric knobs such as 151. The plastic knobs are shown on both sides of the sliding door within the bottom track 125. Similar plastic knobs are provided on the upper track (not shown) of the stationary frame 22 (FIG. 1) to support the sliding door. When the magnet 117 is an electromagnet, it is energized by a coil C1 shown in dotted lines that energize the soft magnetic core 117 by passage of DC current. Similarly, when the magnet 126 is an electromagnet, a winding coil C2, shown in dotted lines, surrounds a soft magnetic core 126 of the electromagnet by passage of DC current.

The magnetically supported sliding track system comprises, in combination, the following salient features:

1. a sliding door or window having a stationary frame and a sliding frame;
2. said stationary frame having a lower portion with a track that has one or more magnets having a common magnetic polarity pointing upwards on its top surface;
3. said sliding frame including a bottom surface having one or more magnets having a common magnetic polarity that is identical to that of the stationary frame magnet but pointing downwards;
4. magnetic repulsion between the track magnet on the lower portion of said stationary frame and the magnet on the bottom surface of the sliding frame supporting the weight of the sliding door or widow, and providing a small air gap;
5. said magnets at the stationary frame lower track and at the bottom of the sliding frame being selected from the group consisting of permanent high energy product magnets and electromagnets energized by passage of DC current;
6. said sliding door or window stationary frame having a plurality of polymeric knobs contacting the sliding frame, preventing front to back displacement of the sliding frame; and
7. said sliding door or window locking in place to thereby prevent sliding movement when the DC power energizing either the lower track electromagnet of the stationary frame or the sliding portion base electromagnet is switched off, thereby dropping the weight sliding portion on the track and magnetically locking the sliding portion against the stationary frame to thereby provide a security feature against intruders;

whereby the sliding frame of the sliding door or window is displaced in the sliding direction with very little friction and is immune to degradation by debris accumulation, wear and mechanical damage.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A sliding door or window supporting system, comprising:

a. a stationary frame having channeled top and bottom frame portions;

b. said channeled bottom portion of said stationary frame having a track with one or more stationary track magnets having a common magnetic polarity pointing upwards;

c. said sliding door or window system having a sliding portion comprising a sliding frame having top and bottom portions;

d. said sliding door or window bottom portion having one or more bottom portion magnets having a common polarity that is identical to that of said one or more stationary track magnets, but pointing downwards;

e. said one or more bottom portion magnets repelling said one or more stationary track magnets and supporting the weight of said sliding portion and creating an air gap between said track and said bottom of said sliding portion, and wherein one or more of said magnets is an electromagnet configured to be energized by a current that can be switched on and off;

f. said sliding door or window stationary frame having a plurality of polymeric knobs contacting the sliding frame, preventing front to back displacement of the sliding frame; and whereby said sliding portion of the sliding door or window is displaced in the sliding direction with very little friction and is immune to degradation by debris accumulation, wear and mechanical damage and said sliding portion is securely locked in position while said current is turned off, wherein one or more of said magnets are electromagnets energized by flow of D.C. current through coils surrounding a soft magnetic core.

2. A sliding door or window supporting system as recited by claim 1, wherein one or more of said magnets are permanent magnets.

3. A sliding door or window supporting system as recited by claim 2, wherein said permanent magnets are neodymium iron boron high energy product magnets.

4. A sliding door or window supporting system as recited by claim 1, wherein said bottom portion of said stationary frame is ferromagnetic and one or more of said stationary track magnets are attached to said bottom portion by magnetic attraction.

5. A sliding door or window supporting system as recited by claim 1, wherein one or more of said stationary track magnets are attached to said bottom portion of said stationary frame by adhesive attachment.

6. A sliding door or window supporting system as recited by claim 1, wherein said sliding door or window bottom portion is ferromagnetic and one or more of said bottom portion magnets are attached to said bottom portion by magnetic attraction.

7. A sliding door or window supporting system as recited by claim 1, wherein one or more of said bottom portion magnets are attached to said sliding door or window bottom portion by adhesive attachment.

8. A sliding door or window supporting system as recited by claim 1, wherein one or more of said bottom portion magnets and one or more of said stationary track magnets are permanent magnets.

9. A sliding door or window supporting system as recited by claim 1, wherein one or more of said stationary frame magnets are electromagnets and one or more of said bottom portion magnets are permanent magnets.

10. A sliding door or window supporting system as recited by claim 9, wherein D.C. current to said electromagnet is turned off to securely lock the sliding portion of said sliding door or window supporting system.

11. A sliding door or window supporting system as recited by claim 1, wherein one or more of said stationary frame magnets and one or more of said bottom portion magnets are electromagnets.

12. A sliding door or window supporting system as recited by claim 11, wherein D.C. current to said electromagnets is turned off to securely lock the sliding portion of said sliding door or window supporting system.

13. A sliding door or window supporting system as recited by claim 1, wherein said polymeric knobs are ultra high molecular weight polyethylene knobs.

14. A sliding door or window supporting system as recited by claim 1, wherein said polymeric knobs are polytetrafluroethylene (PTFE) knobs.

* * * * *